US008275160B2

(12) United States Patent
Kushida et al.

(10) Patent No.: US 8,275,160 B2
(45) Date of Patent: Sep. 25, 2012

(54) DELAY TIME CALCULATION APPARATUS, DELAY TIME CALCULATION METHOD, AND STORAGE MEDIUM STORING PROGRAM THEREFOR

(75) Inventors: Koji Kushida, Hamamatsu (JP); Takashi Yamakawa, Iwata (JP)

(73) Assignee: Yamaha Corporation (JP)

( * ) Notice: Subject to any disclaimer, the term of this patent is extended or adjusted under 35 U.S.C. 154(b) by 499 days.

(21) Appl. No.: 12/467,603

(22) Filed: May 18, 2009

(65) Prior Publication Data

US 2009/0290717 A1 Nov. 26, 2009

(30) Foreign Application Priority Data

May 21, 2008 (JP) ..... 2008-133167

(51) Int. Cl.
*H04R 5/02* (2006.01)

(52) U.S. Cl. ..... 381/300; 381/17; 381/19; 381/303; 381/307; 381/310; 381/61; 381/77; 381/79; 381/80; 381/81; 381/335

(58) Field of Classification Search ..... 381/17–19, 381/300, 303, 307, 310, 61, 77, 79, 80, 81, 381/335

See application file for complete search history.

(56) References Cited

U.S. PATENT DOCUMENTS

2005/0265559 A1* 12/2005 Asada ..... 381/18
2006/0233382 A1 10/2006 Watanabe

FOREIGN PATENT DOCUMENTS

| | | | |
|---|---|---|---|
| EP | 2 056 621 | A2 | 5/2009 |
| JP | 2006-210986 | A | 8/2006 |
| JP | 2006-211230 | A | 8/2006 |
| WO | 01/23104 | A2 | 4/2001 |
| WO | 02/071796 | A1 | 9/2002 |

OTHER PUBLICATIONS

European Search Report dated Jul. 23, 2009 and issued in corresponding European Application No. 09 00 6619.
Japanese Office Action for corresponding JP 2008-133167, mail date Jun. 26, 2012. English translation provided.

* cited by examiner

*Primary Examiner* — Steven Loke
*Assistant Examiner* — Cuong Nguyen
(74) *Attorney, Agent, or Firm* — Rossi, Kimms & McDowell LLP

(57) ABSTRACT

A delay time calculation apparatus that enables all of speaker units constituting a speaker array to contribute to the formation of a combined wavefront directed to an area specified by a user. The delay time calculation apparatus includes a delay time calculation unit that calculates delay times of delayed audio signals supplied to the speaker units such that a ratio at which an evaluation object area is occupied by an area to which an acoustic wave output from each speaker unit reaches earlier than acoustic waves output from the other speaker units falls within a predetermined range. The evaluation object area is a target area to which a combined wavefront of acoustic waves output from the speaker units is directed, or is a perspective projection image of the target area onto a predetermined evaluation plane.

9 Claims, 6 Drawing Sheets

*FIG. 7A*
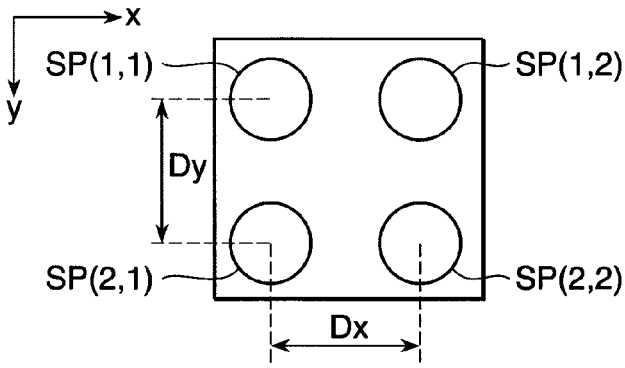
*FIG. 7B*
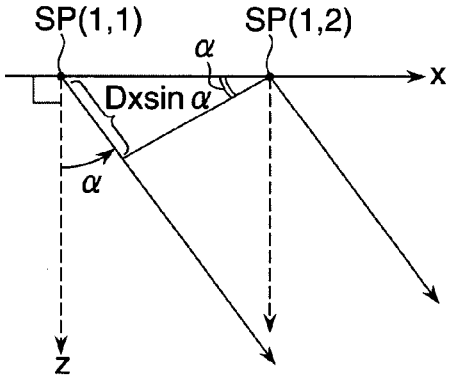
*FIG. 7C*
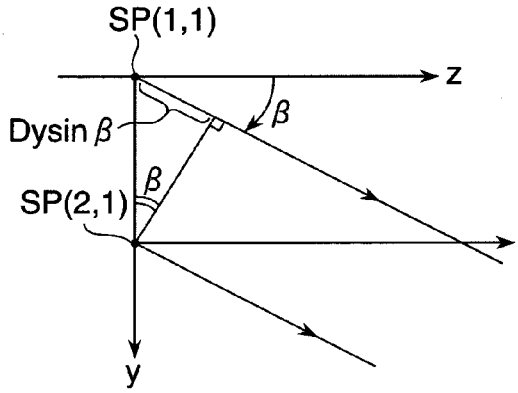
*FIG. 7D*
| SP(1,1) | SP(1,2) |
|---|---|
| 0 | $\frac{D}{\sqrt{2}}$ |
| SP(2,1) | SP(2,2) |
| $\frac{D}{\sqrt{2}}$ | $\frac{2D}{\sqrt{2}}$ |

DELAY TIME CALCULATION APPARATUS, DELAY TIME CALCULATION METHOD, AND STORAGE MEDIUM STORING PROGRAM THEREFOR

BACKGROUND OF THE INVENTION

1. Field of the Invention

The present invention relates to a delay time calculation apparatus for directivity control of a speaker array and relates to a delay time calculation method and a storage medium storing a program therefor.

2. Description of the Related Art

As a speaker array system including a speaker array having a plurality of speaker units, there may be mentioned a delay array type speaker array system (see, for example, Japanese Laid-open Patent Publication No. 2006-211230). In the speaker array system of this type, delay times of audio signals to be supplied to respective speaker units are adjusted to control a directivity characteristic of acoustic waves emitted from the speaker array. The directivity control is to control the propagating direction of a combined wavefront of acoustic waves output from the speaker units and control the degree of spread of the combined wavefront. In the directivity control disclosed in Japanese Laid-open Patent Publication No. 2006-211230, first delay processing for horizontal control is performed on an input audio signal IN10 to generate n first delayed audio signals corresponding to respective ones of speaker unit columns SP(i, 1), SP(i, 2), . . . SP(i, n) (i=1 to m). Next, second delay processing for vertical control is performed on respective ones of the n first delayed audio signals to obtain n×m second delayed audio signals, which are supplied to the speaker units SP(i, j) (i=1 to m, j=1 to n).

In an example technique to specify the propagating direction of a combined wavefront, the propagating direction is specified by vertical and horizontal steering angles. Assuming that a direction normal to an array plane of the speaker array is z axis, a vertical direction is y axis, and a horizontal direction perpendicular to the z and y axes is x axis, the propagating direction of the combined wavefront is specified by rotation angles from the z axis to the x axis and from the z axis to the y axis (horizontal and vertical steering angles). Thus, the propagating direction of the combined wavefront can be represented by a and β degrees by which the combined wavefront is steered leftward in the horizontal direction and downward in the vertical direction, making it easy to intuitively understand the propagation direction.

In the case of, for example, a speaker array having four speaker units SP(i, j) (i=1 to 2, j=1 to 2) arranged in two rows and two columns in the horizontal and vertical directions as shown in FIG. 7A, if the horizontal and vertical steering angles a and β are specified as shown in FIGS. 7B and 7C, a combined wavefront propagating in the direction represented by the two steering angles a and β can be generated by controlling delay time differences between audio signals supplied to the speaker units SP(i, j), as described below.

For speaker units disposed adjacently in the horizontal direction (e.g., speaker units SP(1,1) and SP(1,2)), audio signals are supplied that have a delay time difference therebetween corresponding to a difference between paths of acoustic waves output from these speaker units. For example, with reference to the audio signal for the speaker unit SP(1,1), the audio signal for the speaker unit SP(1, 2) is applied with a delay corresponding to a path difference ($D_x$ sin a (see FIG. 7B)) relative to the speaker unit SP(1, 1). Similarly, forspeakerunits (e.g., SP(1,1) and SP(2, 1)) disposed adjacently in the vertical direction, the audio signal for the speaker unit SP(2,1) is applied with a delay corresponding to a path difference ($D_y$ sin β (see FIG. 7C)) relative to the speaker unit SP(1, 1). Since the speaker unit SP(2,2) has path differences of $D_y$ sin β and $D_x$ sin a relative to the speaker units SP(1,2) and SP(1, 1), an audio signal with a delay corresponding to the sum of the path differences ($D_x$ sin a+$D_y$ sin β) is supplied to the speaker unit SP(2, 2).

With the directivity control specifying the propagating direction of a combined wavefront by horizontal and vertical steering angles and applying delays corresponding to path differences shown in FIGS. 7B and 7C, a problem is sometimes posed that some of the speaker units does not effectively contribute to the formation of the combined wavefront propagating in the direction specified by the steering angles. For example, in a case that relations of $D_x$=$D_y$=D and a=β=45° are satisfied in the speaker array in FIG. 7A, a delay for the speaker unit SP(2,2) becomes excessively large as compared to those for the speaker units SP(1,2) and SP(2,1) (see FIG. 7D), which causes the just-mentioned problem.

SUMMARY OF THE INVENTION

This invention provides a delay time calculation apparatus, a delay time calculation method, and a storage medium storing a program for executing the delay time calculation method, which are able to enable all of speaker units constituting a speaker array to contribute to the formation of a combined wavefront directed to an area specified by a user.

According to a first aspect of this invention, there is provided a delay time calculation apparatus comprising a setting unit adapted to set a target area to which a combined wavefront of acoustic waves output from a plurality of speaker units constituting a speaker array is directed, and a delay time calculation unit adapted to calculate delay times of delayed audio signals to be supplied to respective ones of the speaker units such that ratios at each of which an evaluation object area is occupied by an area to which an acoustic wave output from a corresponding one of the plurality of speaker units reaches earlier than acoustic waves output from other speaker units fall within respective ones of predetermined ranges, the evaluation object area being the target area or being a perspective projection image of the target area onto a predetermined evaluation plane.

With the delay time calculation apparatus of this invention, it is possible to enable the speaker units constituting the speaker array to contribute to the formation of a combined wavefront directed to and propagating toward the target area, so that ratios of coverage of the speaker units become predetermined ratios.

The delay time calculation unit can make an adjustment amount of delay larger for that speaker unit for which a larger deviation of the ratio from the predetermined range is found.

In this case, it is possible to rapidly converge the ratio of coverage of each speaker unit to a value falling within the predetermined range.

The delay time calculation unit can make an adjustment amount of delay of the delayed audio signal to be supplied to that speaker unit for which the ratio is deviated from the predetermined range smaller as deviations of the ratios of the speaker units from the predetermined ranges become smaller.

In this case, it is possible to rapidly converge the ratio of coverage of each speaker unit to a value falling within the predetermined range.

The delay time calculation unit can determine the ratios at each of which the evaluation object area is occupied by the area to which the acoustic wave output from a corresponding one of the speaker units reaches earlier than acoustic waves output from the other speaker units by identifying which acoustic wave among the acoustic waves output from the speaker units reaches earliest a corresponding one of evaluation points, which are lattice points obtained by dividing the evaluation object area into meshes, or projection points obtained by projecting, onto the target area, lattice points obtained by dividing a perspective projection image of the target area onto the evaluation plane into meshes.

A spherical plane passing through a gravity of center of the target area and centered on a center of the array plane can be used as the evaluation plane.

The evaluation points can be distributed according to a sound pressure distribution to be formed in the evaluation object area by sound represented by the combined wavefront.

The delay time calculation unit can assume one or more virtual speaker units other than the plurality of speaker units, and can calculate delay times of delayed audio signals to be supplied to respective ones of the plurality of speaker units such that the ratios for the plurality of speaker units and the one or more virtual speaker units fall within predetermined ranges.

According to a second aspect of this invention, there is provided a delay time calculation method comprising a setting step of setting a target area to which a combined wavefront of acoustic waves output from a plurality of speaker units constituting a speaker array is directed, and a delay time calculation step of calculating delay times of delayed audio signals to be supplied to respective ones of the speaker units such that ratios at each of which an evaluation object area is occupied by an area to which an acoustic wave output from a corresponding one of the plurality of speaker units reaches earlier than acoustic waves output from other speaker units fall within respective ones of predetermined ranges, the evaluation object area being the target area or being a perspective projection image of the target area onto a predetermined evaluation plane.

According to a third aspect of this invention, there is provided a computer-readable storage medium storing a program for causing a computer to execute the delay time calculation method according to the second aspect of this invention.

Further features of the present invention will become apparent from the following description of an exemplary embodiment with reference to the attached drawings.

BRIEF DESCRIPTION OF THE DRAWINGS

FIGS. 7A to 7D are views for explaining an example of directivity control by a conventional delay array type speaker array system.

DETAILED DESCRIPTION OF THE PREFERRED EMBODIMENT

The present invention will now be described in detail below with reference to the drawings showing a preferred embodiment thereof.

Figure 1:
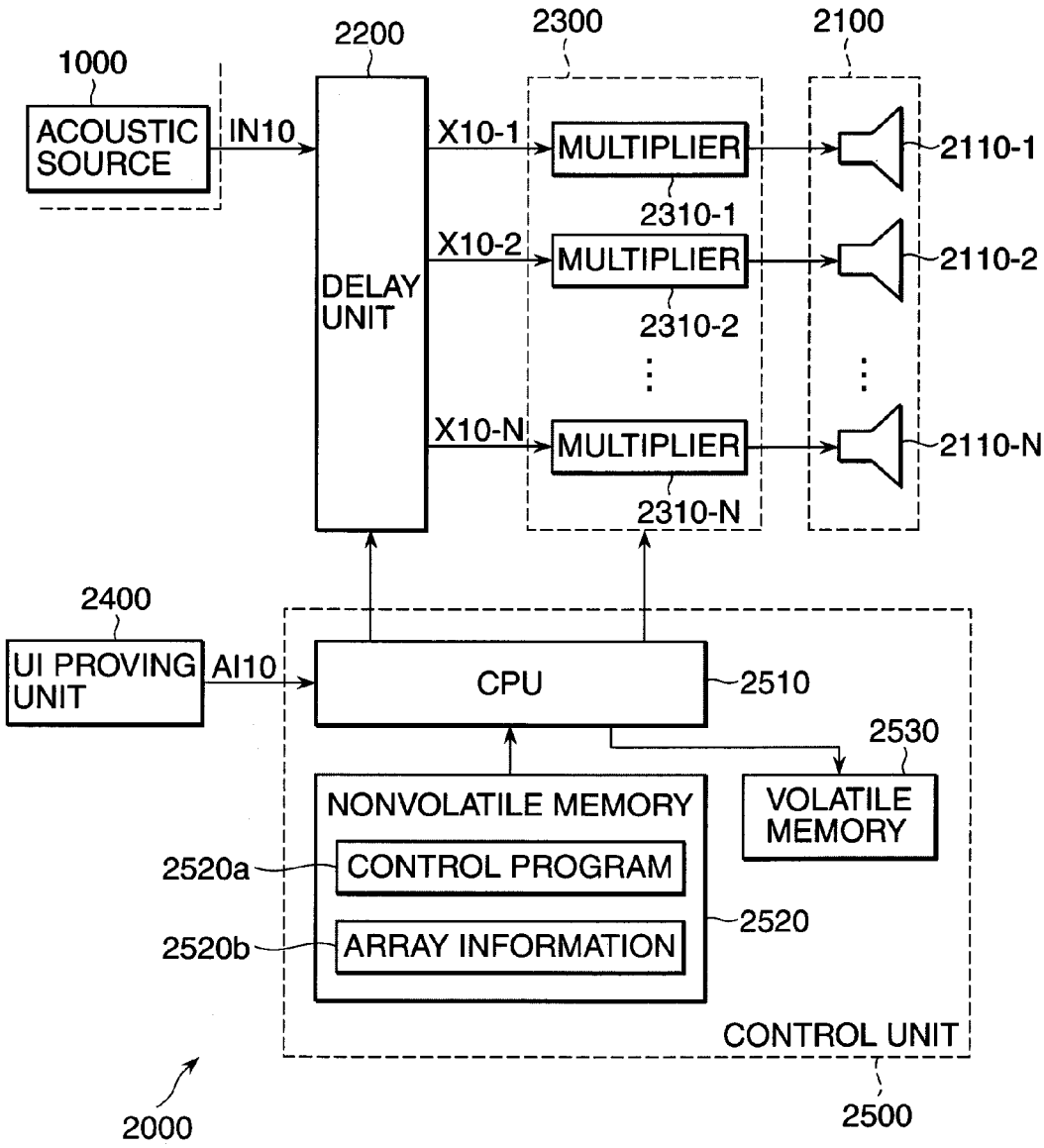
FIG. 1 is a view showing the construction of a speaker array system according to one embodiment of this invention.

FIG. 1 shows the construction of a speaker array system according to one embodiment of this invention. The speaker array system is a so-called delay array type speaker array system. As shown in FIG. 1, the speaker array system 2000 includes a speaker array 2100, a delay unit 2200, an amplification unit 2300, a user interface providing unit (hereinafter referred to as the UI providing unit) 2400, and a control unit 2500.

Figure 2A:
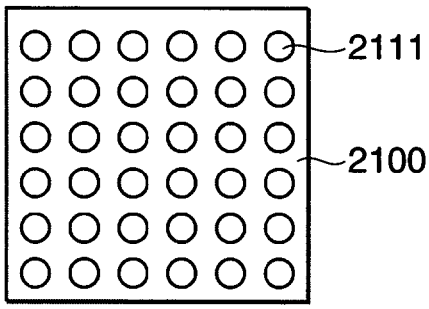
FIGS. 2A and 2B are views each showing an example array plane of a speaker array of the speaker array system.
Figure 2B:
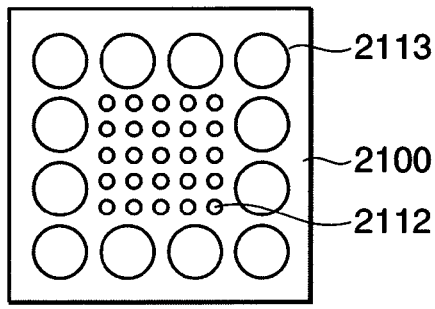

The speaker array 2100 includes speaker units 2110-*i* (i=1 to N, where N represents a natural number not less than 2). The speaker units 2110-*i* are arranged such that speaker axes extend parallel to one another (i.e., a planer baffle surface is formed). In the speaker array system 2000 in FIG. 1, a combined wavefront propagating in a certain propagating direction is formed by an envelop of wavefronts of acoustic waves output from the speaker units 2110-*i* and observed at the same point of time. Cone speakers or other speakers having a wide directivity can be used as the speaker units 2110-*i*. The speaker array 2100 can be constructed by speaker units having the same acoustic characteristic or a combination of plural types of speaker units which are different in acoustic characteristic (e.g., output frequency range). In the case of an arrangement comprised only of speaker units having the same acoustic characteristic as one another, the speaker array 2100 can be formed by speaker units 2111 arranged in a matrix, as shown in FIG. 2A. On the other hand, in the case of an arrangement comprised of a combination of plural types of speaker units having different acoustic characteristics, the speaker array 2100 may be formed, for example, by small-sized speaker units 2112 for high-frequency range arranged in a matrix and large-sized speaker units 2113 for low-frequency range arranged to surround the small-sized speaker units 2112, as shown in FIG. 2B. It should be noted that in a case that the speaker array 2100 is constituted by combining plural types of speaker units which are different in coverage of frequency range as shown in FIG. 2B, it is preferable that reproduction frequency bands of the speaker units should at least partly overlap one another.

The delay unit 2200 is a DSP (digital signal processor), for example. The delay unit 2200 performs delay processing on an input audio signal IN10 supplied from an acoustic source 1000 to generate delayed audio signals X10-*i* (i=1 to N). In a case that an analog signal is input from the acoustic source 1000 as the input audio signal IN10, the analog signal can be converted into a digital signal by an A/D converter before being supplied to the delay unit 2200. In this embodiment, so-called one-tap delay processing is implemented as the delay processing. The one-tap delay processing can be implemented by use of a shift register or a RAM (random access memory). For example, in the case of using a RAM, the delay unit 2200 may perform processing to write the input audio signal IN10 into the RAM and read out the input audio signal IN10 from the RAM upon elapse of time periods corresponding to the delays for the speaker units 2110-*i*, thereby obtaining the delayed audio signals X10-*i* to be supplied to the amplification unit 2300. With this embodiment that generates the delayed audio signals X10-*i* by the one-tap delay processing, the delay unit 2200 can be constituted by a smaller scale DSP than in a case that FIR (finite impulse response) type processing is made to generate the delayed audio signals.

As shown in FIG. 1, the amplification unit 2300 includes multipliers 2310-*i* (i=1 to N) corresponding to respective ones of the speaker units 2110-*i*. The multipliers 2310-*i* are supplied with the delayed audio signals X10-*i* from the delay unit 2200, and multiply the delayed audio signals X10-*i* by predetermined coefficients supplied from the control unit 2500 to thereby amplify the delayed audio signals X10-*i* to a level suited to drive the speakers, and then output the amplified audio signals. The delayed audio signals X10-*i* output from the amplification unit 2300 are converted into analog audio signals by D/A converters (not shown in FIG. 1) and supplied to respective ones of the speaker units 2110-*i*. In a case that shading processing is performed to suppress sidelobe, window function processing using a rectangular or hanning window may be made on the delayed audio signals X10-*i* using the multipliers 2310-*i*.

The UI providing unit 2400 includes a display device such as a liquid crystal display and an input device such as a mouse, and is used by a user to input various information for use when delay times are computed. As the information for the delay time computation, there may be mentioned array information and area information. As an example of the array information, there may be mentioned a coordinate at which an array plane of the speaker array 2100 is centered, and coordinates at which the speaker units 2110-*i* of the speaker array 2100 are disposed, in a case that a three dimensional coordinate (having z axis extending in a direction normal to the array plane, y axis extending in a vertical direction, and x axis extending in a horizontal direction (see FIG. 3)) is defined in a space in which the speaker array 2100 is disposed. The array information input via the UI providing unit 2400 is stored as array information 2520*b* into the nonvolatile memory 2520, as shown in FIG. 1.

Figure 3:
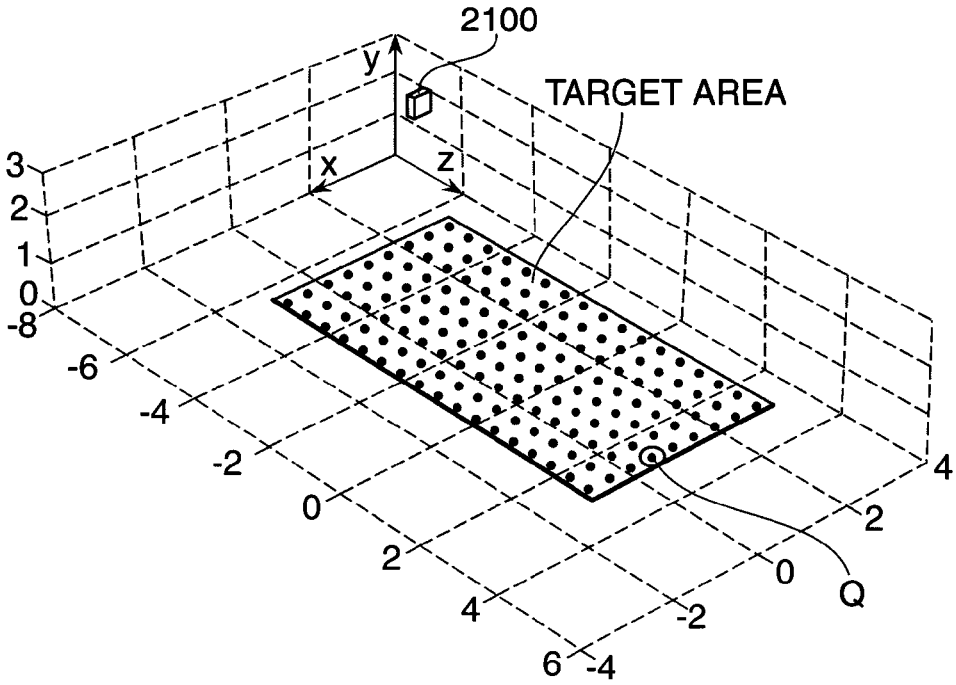
FIG. 3 is a view for explaining an example setting of a target area by a UI providing unit of the speaker array system.

On the other hand, the area information is information representing a target area to which a combined wavefront of acoustic waves output from respective ones of the speaker units 2110-*i* propagates (such as for example, information representing a coordinate of the center of gravity of the target area and the shape and size of the target area). The target area can be set by the user in various manners. For example, a virtual three dimensional coordinate space shown in FIG. 3 is displayed on the display device, and the user describes a target area within the virtual three dimensional space by use of a mouse or other input device. Alternatively, the user can input numeric values representing a coordinate of the center of gravity of the target area, the shape and size of the target area, etc. to set the target area. In the example shown in FIG. 3, a rectangular target area is set. However, the target area has any shape as long as it defines a closed region of a certain shape. Thus, the UI providing unit 2400 functions as a setting unit with which the target area is set by the user. As shown in FIG. 1, the UI providing unit 2400 supplies to the control unit 2500 area information AI10 representing the target area set by the user. In this embodiment, delay times for the delayed audio signals X10-*i* are evaluated (calculated) based on the target area represented by the area information AI01. Thus, the target area is called "evaluation object area".

The control unit 2500 executes a delay time calculation process to calculate the delay times of the delayed audio signals X10-*i* based on the evaluation object area represented by the area information AI10 and executes a process to supply the calculated delay times to the delay unit 2200. As shown in FIG. 1, the control unit 2500 includes a CPU (central processing unit) 2510, a nonvolatile memory 2520 such as a flash ROM, and a volatile memory 2530 such as a RAM. In the nonvolatile memory 2520, the array information 2520*b* is stored and a control program 2520*a* for causing the CPU 2510 to execute the delay time calculation process is stored in advance, by which the speaker array system 2000 is characterized. On the other hand, the volatile memory 2530 is utilized by the CPU 2510 as a work area at execution of the control program 2520*a*. The speaker array system 1 is constructed as described above.

Next, a description is given of the delay time calculation process executed by the CPU 2510 of the control unit 2500 in accordance with the control program 2520*a*.

Figure 4:
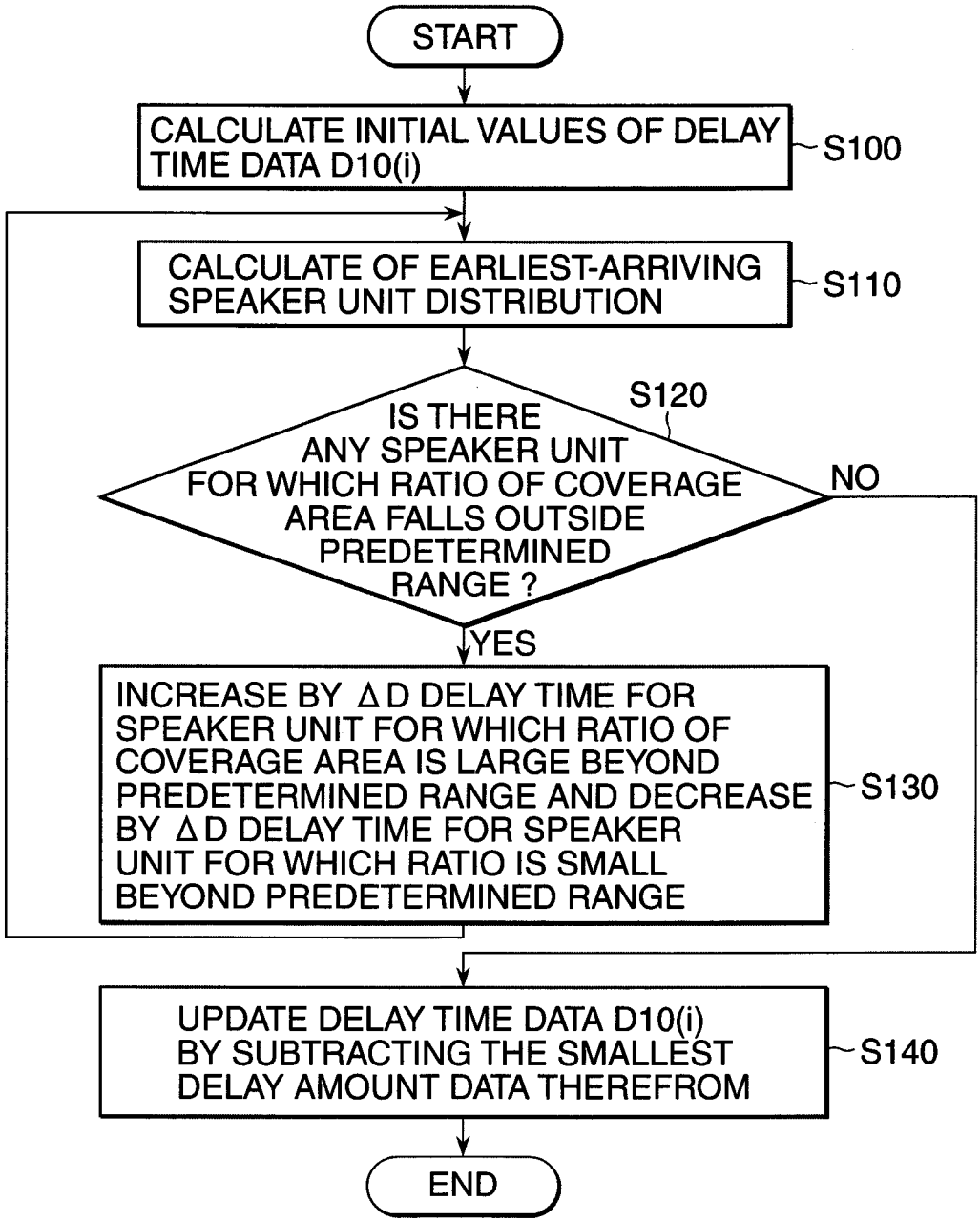
FIG. 4 is a view showing an example of a delay time calculation process performed by a CPU of a control unit of the speaker array system.

FIG. 4 shows in flowchart the flow of the delay time calculation process. As shown in FIG. 4, the CPU 2510 first writes into the volatile memory 2530 initial values of delay time data D10(*i*) (i=1 to N) representing delay times of the delayed audio signals X10-*i* to be supplied to respective ones of the speaker units 2110-*i* (step S100). In step S100, a variety of values can be used as the initial values of the delay time data D10(*i*) to be written into the volatile memory 2530. For example, as the initial values, there may be mentioned values that represent delay times for use when a combined wavefront propagating substantially toward the evaluation object area is formed based on acoustic waves output from the speaker units 2110-*i* by use of the technique disclosed in Japanese Laid-open Patent Publication No. 2006-211230. Alternatively, values representing delay times for use in forming a focus on the center of an evaluation object area, or values representing delay times for use in forming a focus at infinity in a direction from the center of the speaker array 2100 to the center of an evaluation object area can be used as the initial values. Of course, certain fixed values may also be used as the initial values. In the delay time calculation process of this embodiment, the delay time data D10(*i*) subjected to the above described initial setting are optimized by the following processing in steps S110 to S130 and set to the delay unit 2200.

In step S110, the CPU 2510 calculates an earliest-arriving speaker unit distribution for a case where the delay time data D10(*i*) (i=1 to N) stored in the volatile memory 2530 are set to the delay unit 2200. The earliest-arriving speaker unit distribution indicates a distribution of coverage areas of the speaker units 2110-*i* in the evaluation object area. Each coverage area indicates an area in the evaluation object area to which an acoustic wave output from the corresponding speaker unit reaches earlier than acoustic waves output from the other speaker units. The earliest-arriving speaker unit distribution is calculated as described below.

The CPU 2510 divides the evaluation object area into meshes at equal intervals in the x- and z-axis directions. As shown in FIG. 3, evaluation points Q are at lattice points, i.e., at intersections of the meshes. Next, the CPU identifies which acoustic wave among acoustic waves output from the speaker units 2110-*i* (i=1 to N) reaches earliest each evaluation point. In the following, the speaker unit that outputs the acoustic wave which reaches earliest a given evaluation point is called the earliest-arriving speaker unit for the evaluation point. The earliest-arriving speaker unit for a certain evaluation point Q on the evaluation object area can be identified, for example, by calculating values $T_i$ (i=1 to N) in accordance with the following formula (1) for the respective speaker units 2110-*i* and identifying an index i that corresponds to the minimum value among the values $T_i$ which are N in number. It should be noted that D10(*i*) in formula (1) is delay time data representing a delay time of the delayed audio signal X10-*i* to be supplied to the corresponding speaker unit 2110-*i*. In formula (1), |Q-SP(i)| indicates a distance between the evaluation point Q and the speaker unit 2110-*i*, which is calculated based on a coordinate of the evaluation point Q and a coordinate of the speaker unit 2110-*i* represented by the array information 2520*b*, and *c* denotes sound velocity. Thus, the first term on the right side of formula (1) represents a time period required from when the audio signal IN10 from the acoustic source 1000 is input to the speaker array system 2000 until when a sound corresponding to the audio signal is output from the speaker unit 2110-*i*, and the second term on the right side of formula (1) represents a time period required from when the acoustic wave is output from the speaker unit 2110-*i* until when the acoustic wave reaches the evaluation point Q.

$$Ti=D10(i)+|Q-SP(i)|/c \quad (1)$$

Upon completion of the identification of the earliest-arriving speaker units for all the evaluation points in the evaluation object area, the CPU 2510 adds up, in respect of each of the speaker unit 2110-*i* (i=1 to N), the number of evaluation points for which a given speaker unit is the earliest-arriving speaker unit. As previously described, in this embodiment, the evaluation points are provided in the evaluation object area at equal intervals in the x- and z-axis directions. Thus, a value obtained by dividing the number of evaluation points for which a given speaker unit is the earliest-arriving speaker unit by the total number of the evaluation points in the evaluation object area nearly coincides with a ratio of the dimensions of coverage area of the speaker unit to that of the entire evaluation object area. In this manner, ratios of coverage areas of the speaker units 2110-*i* (i=1 to N) to the entire evaluation object area are calculated.

Next, the CPU 2510 determines whether or not there is any speaker unit for which the ratio of the coverage area calculated in step S110 falls outside a predetermined range (step S120). The predetermined range can be determined variously. In this embodiment, as the predetermined range, a range of plus or minus several percent around a value obtained by dividing the dimensions of the entire evaluation object area (or the total number of the evaluation points in the evaluation object area) by the number of the speaker units 2110-*i* is used, to thereby make the evaluation object area equally covered by the respective speaker units 2110-*i*. It should be noted that the range of plus or minus several percent can appropriately be determined based on the required accuracy of propagating direction of or the degree of spread of the combined wavefront and the length of time required for the delay time computation. If the answer to step S120 becomes NO (i.e., if the ratios between the coverage areas of all the speaker units and the entire evaluation object area each fall within the predetermined range), the CPU 2501 executes processing in step S140 described later and completes the delay time calculation process. If, on the other hand, the answer to step S120 becomes YES, the CPU 2510 proceeds to step S130.

In step S130, the CPU 2510 determines one or more speaker units whose coverage area ratio is excessively large beyond the predetermined range and one or more speaker units whose coverage area ratio is excessively small beyond the predetermined range. Then, the CPU 2510 increases, by a predetermined adjustment amount ΔD, the delay time data stored in the volatile memory 2530 for each speaker unit whose coverage area ratio is excessively large, and decreases, by ΔD, the delay time data for each speaker unit whose coverage area ratio is excessively small. In the following, a description is given of the reason why the delay time data is increased if the ratio of the coverage area to the entire evaluation object area is excessively large and decreased if the ratio is excessively small.

The time period $T_i$ required from when the audio signal IN10 is input to the speaker system 2000 until when the acoustic wave output from the speaker unit 2110-*i* (i=1 to N) reaches a given evaluation point Q is represented by formula (1), as previously described. In a case that the earliest-arriving speaker unit for the evaluation point Q is the k-th speaker unit 2110-*k* and the ratio of the coverage area of the speaker unit 2110-*k* to the entire evaluation object area is excessively large, the processing is carried out to increase, by ΔD, the delay time data D10-*k* of the delayed audio signal X10-*k* to be supplied to the speaker unit 2110-*k*, whereby the required time period $T_k$ associated with the speaker unit 2110-*k* is increased by ΔD.

If the delay time data D10-*k* is updated as described above, a change occurs in the time period required for the acoustic wave output from the speaker unit 2110-*k* to reach the evaluation point Q. Thus, the speaker unit 2110-*k* is not necessarily the earliest-arriving speaker unit for the evaluation point Q after the delay time data D10-*k* is updated. In a case, for example, that the j-th speaker unit 2110-*j* (j≠k) is the smallest next to the speaker unit 2110-*k* in the required time period in formula (1) and the required time period $T_j$ satisfies a relation of $T_k<T_j<T_k+\Delta D$, the speaker unit 2110-*j* becomes the earliest-arriving speaker unit for the evaluation point Q, instead of the speaker unit 2110-*k*. If the delay time data D10(*i*) is increased in this manner, the number of evaluation points covered by the speaker unit 2110-*i* supplied with the delayed audio signal X10-*i* whose delay time is represented by the delay time data D10(*i*) (i.e., the ratio of the coverage area to the entire evaluation object area) is decreased and becomes closer to a value falling within the predetermined range. On the other hand, if the delay time data D10(*i*) is decreased, the ratio of the coverage area to the entire evaluation object area is increased as apparent from the foregoing description. The above is the reason why the delay time data D10(*i*) is increased if the ratio of the coverage area to the entire evaluation object area is excessively large, and decreased if the ratio of the coverage area to the entire evaluation object area is excessively small.

As the adjustment amount ΔD of the delay time data D10(*i*), there may be used a fixed value or a value that varies according to an excess (or deficiency) relative to the predetermined range. For example, a value that increases with the increasing deviation from the center of the predetermined range may be used. The adjustment amount ΔD can be computed according to, e.g., the following formula (2), where |R| represents the magnitude of the excess (or deficiency) and a represents a predetermined proportional constant.

$$\Delta D=a\times|R| \quad (2)$$

After execution of the processing in step S130, the CPU 2510 executes the processing in step S110 again. The processing in step S130 is therefore repeatedly carried out until the answer to step S120 becomes NO (i.e., until when the ratios of the coverage areas of all the speaker units 2110-*i* to the entire evaluation object area fall within the predetermined range).

If the answer to step S120 becomes NO, the CPU 2510 carries out processing to update each of the delay time data D10(*i*) (i=1 to N) stored in the volatile memory 2530 to a value obtained by subtracting the smallest one among the delay time data from each thereof and set the updated data to the delay unit 2200 (step S140), and completes the delay time calculation process. The reason why the value obtained by subtracting the smallest one among the delay time data D10(*i*) from each thereof is set to the delay unit 2200 as the delay time of the delayed audio signal X10-*i* supplied to the speaker unit 2110-*i* is to reduce the entire delay time and prevent the delay time from having a negative value.

After completion of the above described setting of the delay times for the speaker units 2110-*i* (i=1 to N), the delay unit 2200 performs processing to apply delays corresponding to the delay times to the input audio signal IN10 supplied from the acoustic source 1000, to thereby generate and output the delayed audio signals X10-*i* (i=1 to N). Sounds corresponding to the delayed audio signals X10-*i* are output from the speaker units 2110-*i*. A combined wavefront having a predetermined wavefront (in general, an aspherical wavefront) and propagating toward the evaluation object area is formed by acoustic waves output from the speaker units 2110-*i*.

Figure 5:
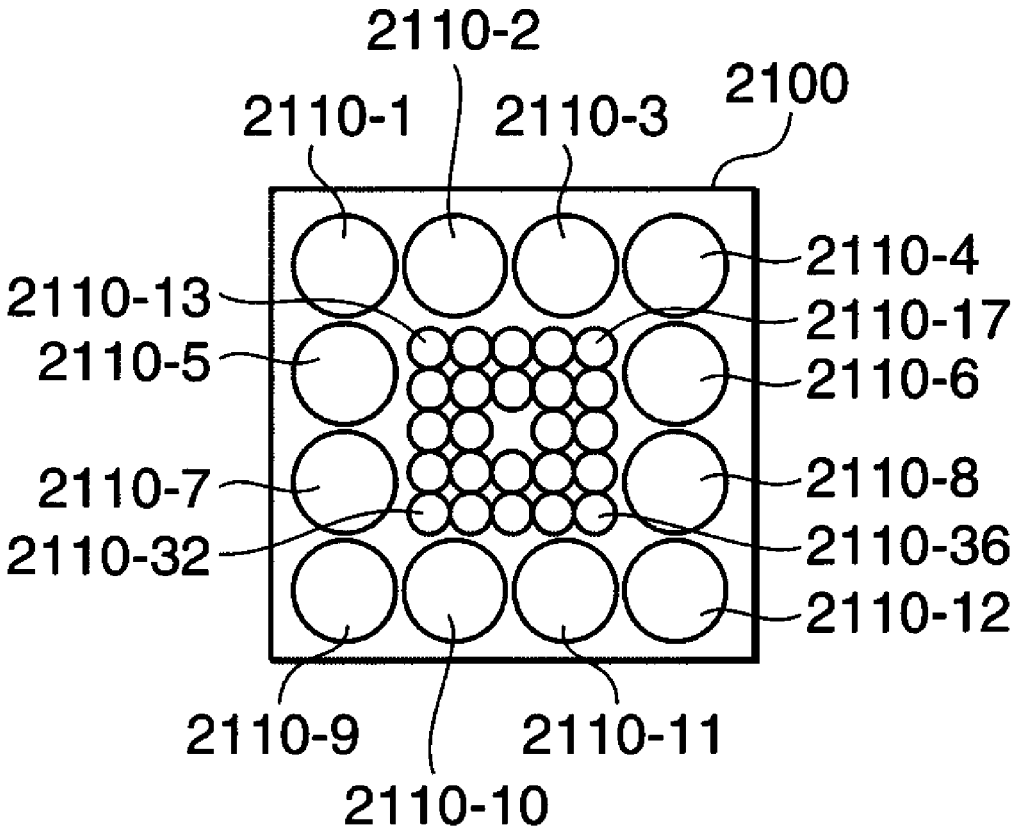
FIG. 5 is a front view of a speaker array for explaining effects achieved by the embodiment.
Figure 6A:
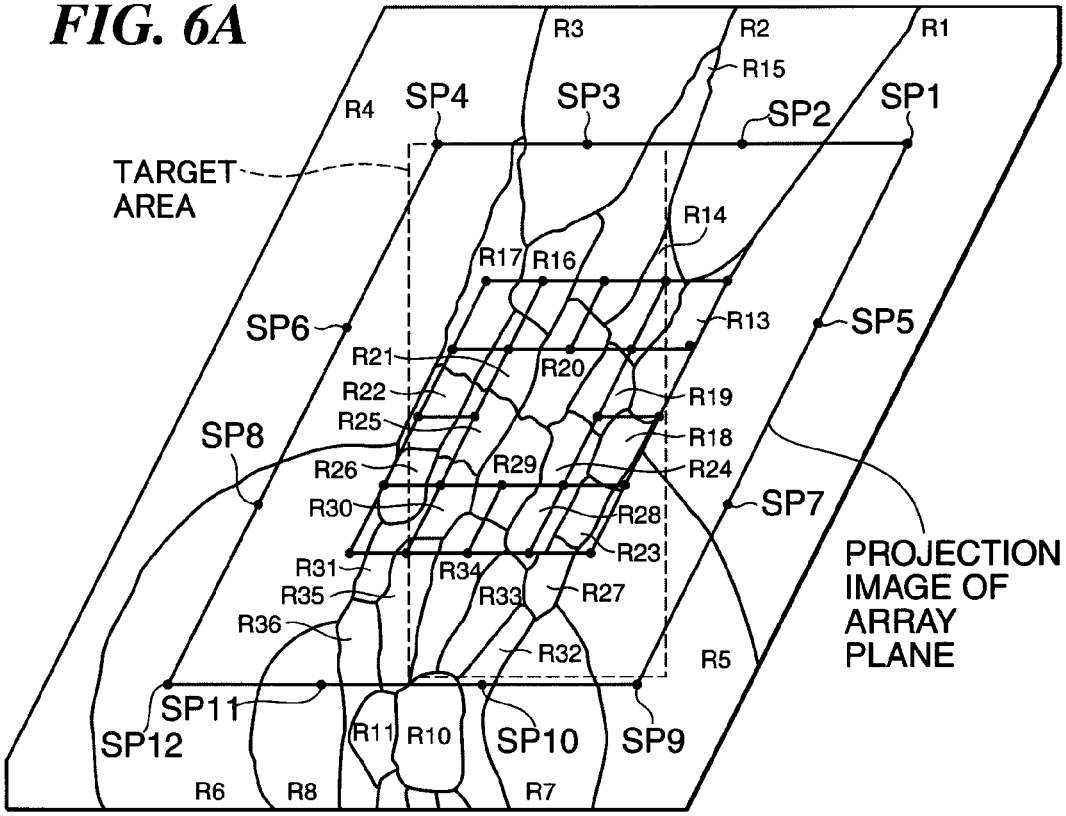
FIGS. 6A and 6B are views for explaining effects achieved by the embodiment.
Figure 6B:
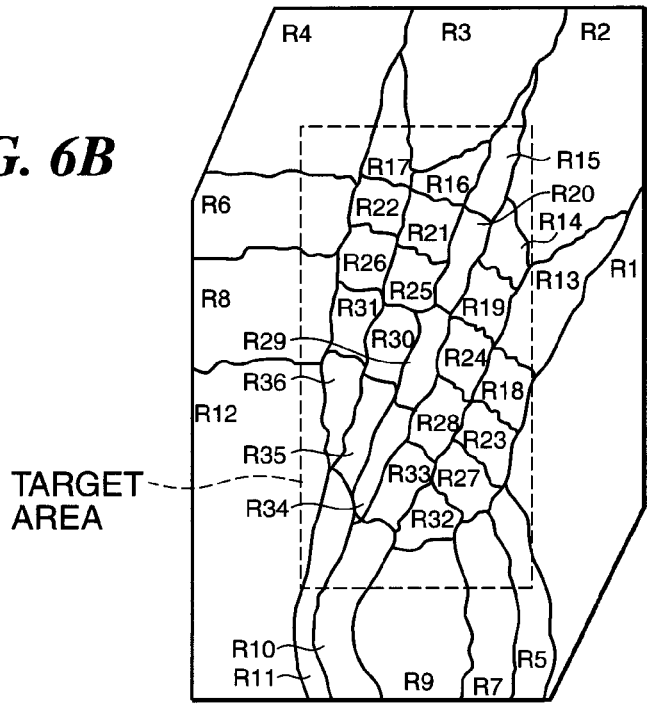

In a conventional delay array type control, for a speaker array 2100 having 36 speaker units 2110-1 to 2110-36 arranged as shown in FIG. 5, for example, delay times of delayed audio signals to be supplied to speaker units are calculated as follows: Specifically, as shown in FIG. 6A, an array plane is projected onto a target area (shown by a dotted line) such as to cover the target area, and based on the projected image, target arrival points SP1 to SP36 of acoustic waves output from the speaker units 2110-*m* (m=1 to 36) are determined. Then, in accordance with differences between paths connecting the speaker units 2110-*m* and the target arrival points SPm, delay times of delayed audio signals to be supplied to the speaker units 2110-*m* are calculated. In FIG. 6A, coverage areas of the speaker units 2110-*m* are denoted by Rm (m=1 to 36) for a case where the delay times are determined as described above. As apparent from FIG. 6A, delay times for the speaker units 2110-9 and 2110-12 are excessively large and there are no coverage areas of these speaker units. In other words, the speaker units 2110-9 and 2110-12 do not contribute to the formation of a wavefront directed to the target area. On the other hand, in a case that delayed audio signals with delay times calculated according to the technique of this embodiment are supplied to the speaker units, a distribution of coverage areas of the speaker units 2110-*m* shown in FIG. 6B can be attained. As apparent from a comparison between FIGS. 6B and 6A, according to this embodiment, all the speaker units contribute to the formation of a combined wavefront propagating toward the evaluation object area. In this embodiment, the evaluation object area is the target area itself, and therefore all the speaker units contribute to the formation of the combined wavefront propagating toward the target area.

As described above, according to this embodiment, the directivity of the combined wavefront formed by acoustic waves output from the speaker units 2110-*i* can intuitively be adjusted based on the position and shape of the target area, and therefore it is unnecessary to calculate, prior to delay time computation, to which directions acoustic waves output from the speaker units 2110-*i* should be propagated. Conventionally, a problem is posed that some speaker units do not contribute to the formation of a combined wavefront propagating the intended direction, even if delay times of delayed audio signals to be supplied to speaker units are adjusted such that acoustic waves output from speaker units 2110-*i* propagate in predetermined directions. On the other hand, according to this embodiment, it is possible to enable all the speaker units 2110-*i* constituting the speaker array 2100 to contribute to the formation of a combined wavefront propagating in the direction intended by the user, by determining delay time data D10(*i*) of delayed audio signals X10-*i* to be supplied to the speaker units 2110-*i* so that coverage areas of the speaker units 2110-*i* are equalized, as described above. According to this embodiment, since the speaker units 2110-*i* constituting the speaker array 2100 contribute to the formation of a combined wavefront directed to the target area, delay time differences are made small observed when acoustic waves output from the speaker units 2110-*i* reach the evaluation point. Thus, the resultant wavefront at the evaluation points can be intensified. Since the delay processing executed by the delay unit 2200 of the speaker array system 1 of this embodiment is one-tap delay processing, the delay unit 2200 can be formed by a small scale DSP and therefore the construction of the speaker system 1 can be simplified.

In the above, there has been described one embodiment of this invention, which may be modified variously as described below.

(First Modification)

In the embodiment, this invention is applied to a two-dimensional speaker array in which a plurality of speaker units are arranged to form a planar baffle surface. However, this invention is, of course, applicable to a speaker array having speaker units arranged to form a curved baffle surface.

(Second Modification)

In the embodiment, the coverage areas of the speaker units 2110-*i* constituting the speaker array 2100 are equalized, but the dimensions of the coverage areas can be made different between speaker units. Specifically, the dimensions of coverage areas can be made different according to types of speaker units or installation positions thereof on the speaker array. The dimensions of coverage areas can be made different according to installation conditions of the speaker units such that coverage areas of speaker units disposed at a larger spacing distance are made larger. In that case, the ratio of the coverage area of each speaker unit to the entire evaluation object area is specified by the user, and it is determined in step S130 whether or not the ratio of coverage area calculated in step S110 for each speaker unit falls with a range around the specified ratio. A width of the range can be specified by the user. In a case that a narrow width of the range is specified, it is possible for the ratio of coverage area of the corresponding speaker unit to the entire evaluation object area to converge to a value close to the specified ratio, but a computation time required for the convergence becomes long. On the other hand, if a wide width of the range is specified, the computation time can be shortened, but a deviation of the ratio of the coverage area of each speaker unit to the entire evaluation object area from the specified ratio becomes large.

(Third Modification)

In the embodiment, there have been described cases where a fixed value and a value (see, formula (2)) determined according to the excess (or deficiency) R of the ratio of the coverage area of each speaker unit 2110-*i* to the entire evaluation object area are respectively used as adjustment amount AD for adjustment of delay time data D10(*i*). However, the delay time data D10(*i*) can be calculated using other technique. For example, during the process to repeatedly execute the processing in steps S110 to S130 in FIG. 4, the adjustment amount AD for delay time may be made smaller for a smaller deviation of the ratio of coverage area from a predetermined range for each speaker unit (for example, the number of speaker units for which the ratio of coverage area falling outside the predetermined range becomes smaller). In a case, for example, that a value computed according to formula (2) is used as the adjustment amount ΔD, a value of the proportional coefficient a may be made smaller at each execution of the processing in steps S110 to S130 in FIG. 4. By doing this, it is possible to shorten the processing time required until when the ratio of coverage area of each speaker unit 2110-*i* converges to within the predetermined range, like a case to rapidly converge an adaptive filter.

(Fourth Modification)

In the embodiment, the ratios of coverage area of a plurality of speaker units 2110-*i* (i=1 to N) constituting the speaker array 2100 to the entire evaluation object area are calculated, and delay times of delayed audio signals X10-*i* to be supplied to the speaker units 2110-*i* are determined. Alternatively, dummy speaker units not present actually in the speaker array (hereinafter referred to as the virtual speaker units) may be assumed, coverage areas may also be assigned to virtual speaker units, and delay times of delayed audio signals to be supplied to the speaker units may be calculated. In that case, only delay times of delayed audio signals supplied to speaker units which are actually present may be made processing objects of the processing to make a minimum delay time zero (processing in step S140 in FIG. 4). By executing the delay time calculation using such virtual speaker units, coverage areas can be assigned to respective speaker units in a more orderly fashion.

(Fifth Modification)

In the embodiment, the target area itself is the evaluation object area, and lattice points obtained by dividing the evaluation object area into meshes at equal intervals are the evaluation points. Alternatively, the evaluation object area may be a perspective projection image of the target area onto a predetermined plane (hereinafter referred to as the evaluation plane), and delay time data D10(*i*) of delayed audio signals X10-*i* to be supplied to the speaker units 2110-*i* may be calculated by executing the processing in FIG. 4 using evaluation points obtained by dividing such an evaluation object area into meshes. As examples of the evaluation plane, there may be mentioned a spherical plane passing through the center of gravity of the target area and centered on the center of the baffle surface of the speaker array 2100, and a plane obtained by slightly tilting in one, two or three of the x, y and z axes a plane containing the target area.

In a case, for example, that a spherical plane passing through the center of gravity of the target area and centered on the center of the baffle surface of the speaker array 2100 is used as the evaluation plane and evaluation points are set by dividing the evaluation object area, which is an perspective projection image of the target area onto the evaluation plane, into meshes at equal intervals, distances between the evaluation points on the evaluation object area and the speaker array 2100 are nearly constant irrespective of a relative positional relation between the speaker array 2100 and the target area. Thus, if the coverage areas of the speaker units 2110-*i* (i=1 to N) are equalized, solid angles corresponding to these coverage areas become constant, making it possible to prevent a wavefront from being unbalanced due to difference in distance to the evaluation points. On the other hand, distances from the speaker array 2100 to the evaluation points vary depending on a relative positional relation between the speaker array 2100 and the evaluation object area (i.e., the directions of evaluation points as seen from the speaker array 2100) in an arrangement where the target area itself is the evaluation object area and evaluation points are set by dividing the evaluation object area into meshes at equal intervals (i.e., the evaluation plane is a plane containing the target area) as described in the embodiment, or in an arrangement where an evaluation plane slightly tilted in one, two, or three axes and evaluation points are set by dividing the evaluation object area, which is a perspective projection image of the target area onto the evaluation plane, into meshes at equal intervals. When coverage areas are equalized on an evaluation plane with which distances to evaluation points vary according to direction, wavefronts having smaller solid angles are assigned to evaluation points located at more distant locations, and therefore the wavefronts are more concentrated to evaluation points located at more distant locations. Since wavefronts are more concentrated to evaluation points at more distant locations, it is expected that sound pressure differences due to distance attenuation are reduced. In the arrangement where a plane containing the target area and slightly tilted in one, two, or three of the x, y, and z axes is used as the evaluation plane, it is especially effective to use, as the evaluation plane, a plane obtained by rotation (an amount of rotation can be specified by the user) around a rotary axis passing through the center of the target area and extending perpendicular to a plane (auxiliary plane) that extends perpendicular to the target area and contains the center of the baffle surface of the speaker array 2100 and the center of the target area.

The evaluation points are not essentially required to be provided on the evaluation object area. Alternatively, the evaluation points may be projection points obtained by projecting, onto the target area, lattice points obtained by dividing the perspective projection image of the target area onto the evaluation plane into meshes at equal intervals. It should be noted that in the setting of evaluation points, it is of course preferable that the evaluation points be set such that a direction pattern is in an appropriate range (e.g., in front of the speaker array) by taking account of direction patterns of speaker units constituting the speaker array, irrespective whether or not the evaluation points are set on the evaluation object area.

(Sixth Modification)

In the embodiment, evaluation points for delay time computation are uniformly provided. In that case, the ratio of the number of evaluation points is made equivalent to the ratio of dimensions. However, the evaluation point distribution density can, of course, be made different between locations on the evaluation object area. Even in a case that delay times are adjusted such that the ratio of the number of evaluation points covered by each speaker unit is equalized between the speaker units 2110-*i*, if the evaluation point distribution is not uniform on the evaluation object area, the dimensions of a coverage area per one evaluation point becomes smaller at a location having a higher evaluation point density, resulting in concentrated wavefronts. In an area where the wavefront is concentrated, the sound pressure produced by a combined wavefront formed by the wavefronts becomes high. Utilizing this, in order to, e.g., increase the sound pressure in a particular area in the evaluation object area, evaluation points are distributed so as to increase the evaluation point density in the particular area. In this manner, the sound pressure, etc. can finely be adjusted according to locations by making the evaluation point distribution on the evaluation object area different between locations.

(Seventh Modification)

In the embodiment, the UI providing unit 2400 and the control unit 2500 of the speaker array system 2000 are adapted to function as a setting unit for setting the target area and the control unit 2500 is adapted to function as a delay time calculation unit for calculating delay times of delayed audio signals X10-*i* to be supplied to the speaker units 2110-*i* based on the evaluation object area. However, it is, of course, possible to combine the setting unit and the delay time calculation unit so as to configure a delay time calculation apparatus suitable for delay time control of a delay array type speaker array. A control program for causing a computer apparatus to function as the setting unit and the delay time calculation unit (in the embodiment, the control program 2502*a*) may be stored for distribution in a CD-ROM (compact disk-read only memory) or other computer-readable recording medium, or may be able to be downloaded for distribution via the Internet or other electronic communication line. The thus distributed control program may be stored into an ordinary computer apparatus and a CPU of the computer apparatus may be operated according to the control program, whereby the ordinary computer apparatus can be used as the delay time calculation apparatus.

What is claimed is:

1. A delay time calculation apparatus comprising:

a setting unit adapted to set a target area to which a combined wavefront of acoustic waves output from a plurality of speaker units constituting a speaker array is directed; and a delay time calculation unit adapted to calculate delay times of delayed audio signals to be supplied to respective ones of the speaker units such that ratios of respective speaker unit coverage areas to an entire evaluation object area fall within respective ones of predetermined ranges, the entire evaluation object area being the target area or being a perspective projection image of the target area onto a predetermined evaluation plane.

2. The delay time calculation apparatus according to claim 1, wherein the delay time calculation unit makes an adjustment amount of delay larger for that speaker unit for which a larger deviation of the ratio from the predetermined range is found.

3. The delay time calculation apparatus according to claim 1, wherein the delay time calculation unit makes an adjustment amount of delay of the delayed audio signal to be supplied to that speaker unit for which the ratio is deviated from the predetermined range smaller as deviations of the ratios of the speaker units from the predetermined ranges become smaller.

4. The delay time calculation apparatus according to claim 1, wherein the delay time calculation unit determines the ratios by identifying which acoustic wave among the acoustic waves output from the speaker units reaches a corresponding one of evaluation points earliest, the evaluation points being lattice points obtained by dividing the entire evaluation object area into meshes, or being projection points obtained by projecting, onto the target area, lattice points obtained by dividing a perspective projection image of the target area onto the evaluation plane into meshes.

5. The delay time calculation apparatus according to claim 4, wherein a spherical plane passing through a center of gravity of the target area and centered on a center of an array plane of the speaker array is the evaluation plane.

6. The delay time calculation apparatus according to claim 4, wherein the evaluation points are distributed according to a sound pressure distribution to be formed in the entire evaluation object area by sound represented by the combined wavefront.

7. The delay time calculation apparatus according to claim 1, wherein the delay time calculation unit assumes one or more virtual speaker units other than the plurality of speaker units, and calculates delay times of delayed audio signals to be supplied to respective ones of the plurality of speaker units such that the ratios for the plurality of speaker units and the one or more virtual speaker units fall within predetermined ranges.

8. A delay time calculation method comprising:

a setting step of a computer setting a target area to which a combined wavefront of acoustic waves output from a plurality of speaker units constituting a speaker array is directed; and a delay time calculation step of a computer calculating delay times of delayed audio signals to be supplied to respective ones of the speaker units such that ratios of respective speaker unit coverage areas to an entire evaluation object area fall within respective ones of predetermined ranges, the entire evaluation object area being the target area or being a perspective projection image of the target area onto a predetermined evaluation plane.

9. A non-transitory computer-readable storage medium storing a program for causing a computer to execute the delay time calculation method as set forth in claim 8.

* * * * *